US012152200B2

(12) United States Patent
Jo et al.

(10) Patent No.: US 12,152,200 B2
(45) Date of Patent: Nov. 26, 2024

(54) METHOD AND SYSTEM FOR PRODUCING REFINED HYDROCARBONS FROM WASTE PLASTICS

(71) Applicants: SK INVESTMENT CO., LTD., Seoul (KR); SK GEO CENTRIC CO., LTD., Seoul (KR)

(72) Inventors: Sang Hwan Jo, Daejeon (KR); Soo Kil Kang, Daejeon (KR); Yong Woon Kim, Daejeon (KR); Min Gyoo Park, Daejeon (KR); Min Woo Shin, Daejeon (KR); Jin Seong Jang, Daejeon (KR)

(73) Assignees: SK INVESTMENT CO., LTD., Seoul (KR); SK GEO CENTRIC CO., LTD., Seoul (KR)

( * ) Notice: Subject to any disclaimer, the term of this patent is extended or adjusted under 35 U.S.C. 154(b) by 0 days.

(21) Appl. No.: 18/412,599

(22) Filed: Jan. 15, 2024

(65) Prior Publication Data

US 2024/0352324 A1 Oct. 24, 2024

(30) Foreign Application Priority Data

Apr. 19, 2023 (KR) ..... 10-2023-0051631
Sep. 21, 2023 (KR) ..... 10-2023-0126307

(51) Int. Cl.
*C10G 1/10* (2006.01)
*C10G 7/00* (2006.01)

(52) U.S. Cl.
CPC ..... *C10G 1/10* (2013.01); *C10G 7/00* (2013.01); *C10G 2300/1003* (2013.01)

(58) Field of Classification Search
None
See application file for complete search history.

(56) References Cited

U.S. PATENT DOCUMENTS 10,814,525 B1 * 10/2020 Geronimi ..... C10G 1/00
11,639,472 B2 * 5/2023 Timken ..... C10G 1/002 585/241

FOREIGN PATENT DOCUMENTS

| | | | |
|---|---|---|---|
| KR | 10-0759583 | B1 | 9/2007 |
| KR | 10-1916404 | B1 | 11/2018 |
| KR | 10-2206106 | B1 | 1/2021 |
| KR | 10-2021-0057722 | A | 5/2021 |
| KR | 10-2023-0050510 | A | 4/2023 |
| WO | 2023/009398 | A1 | 2/2023 |

OTHER PUBLICATIONS

Extended European Search Report for European Patent Application No. 24162610.0 issued by the European Patent Office on Sep. 11, 2024.

* cited by examiner

*Primary Examiner* — Tam M Nguyen
(74) *Attorney, Agent, or Firm* — IP & T GROUP LLP

(57) ABSTRACT

Embodiments of the present disclosure relate to a method for producing refined hydrocarbons from waste plastics, the method including: a pretreatment process of pretreating waste plastics; a pyrolysis process of producing pyrolysis gas by introducing the waste plastics pretreated in the pretreatment process into a pyrolysis reactor; a lightening process of producing pyrolysis oil by introducing the pyrolysis gas into a hot filter; and a distillation process of distilling the pyrolysis oil to obtain refined hydrocarbons, wherein a liquid condensed in the hot filter is re-introduced into the pyrolysis reactor, and a system for producing refined hydrocarbons from waste plastics.

11 Claims, 3 Drawing Sheets

METHOD AND SYSTEM FOR PRODUCING REFINED HYDROCARBONS FROM WASTE PLASTICS

CROSS-REFERENCE TO RELATED APPLICATIONS

This application claims priority under 35 U.S.C. § 119 to Korean Patent Application No. 10-2023-0051631 filed on Apr. 19, 2023, and Korean Patent Application No. 10-2023-0126307, filed on Sep. 21, 2023, the disclosures of which are incorporated herein by reference in their entirety.

TECHNICAL FIELD

Embodiments of the present disclosure relate to a method and system for producing refined hydrocarbons from waste plastics.

BACKGROUND

Since pyrolysis oil produced by a cracking or pyrolysis reaction of waste materials, such as waste plastic pyrolysis oil, contains a large amount of impurities caused by the waste materials, there is a risk of emission of air pollutants such as $SO_x$ and $NO_x$ when the pyrolysis oil is used as fuel. In particular, chlorine ("Cl") impurities can be converted into HCl and can cause device corrosion during a high-temperature treatment process.

In the related art, Cl is typically removed through post-treatment processes such as a hydrodesulfurization (hydrotreating) process and a Cl treatment process using an oil refining technique. However, since pyrolysis oil such as waste plastic pyrolysis oil has a high content of Cl, problems such as equipment corrosion, abnormal reactions, and deterioration of product properties caused by an excessive amount of HCl produced in the hydrodesulfurization process have been reported. Therefore, it is difficult to introduce non-pretreated pyrolysis oil to the hydrodesulfurization process. Thus, for removing the Cl using the conventional oil refining process, there is a need for a Cl reduction treatment technique for reducing the content of Cl in the pyrolysis oil to a level that can be introduced into the oil refining process.

Moreover, for securing economic feasibility, in addition to impurity removal, it is required for the waste plastic pyrolysis oil to be high-value added through yield improvement and lightening of the waste plastic pyrolysis oil. Furthermore, there is a need to develop a technique for obtaining refined hydrocarbons having a high proportion of light hydrocarbons from the waste plastic pyrolysis oil.

SUMMARY

An embodiment of the present disclosure is directed to producing high-value-added pyrolysis oil having a high proportion of light hydrocarbons from waste plastics containing a large amount of impurities, and to obtaining refined hydrocarbons having a high proportion of light hydrocarbons therefrom.

Another embodiment of the present disclosure is directed to improving a yield of the pyrolysis oil obtained from waste plastics.

Still another embodiment of the present disclosure is directed to producing high-value-added pyrolysis oil with reduced impurities from waste plastics containing a large amount refined hydrocarbons with of impurities, and to obtaining reduced impurities therefrom.

Still another embodiment of the present disclosure is directed to providing a method and system with a simplified process of producing refined hydrocarbons from waste plastics.

Still another embodiment of the present disclosure is directed to producing high-value-added pyrolysis oil that may be used as a feedstock for blending with existing petroleum products or an oil refining process due to its excellent quality, and to obtaining refined hydrocarbons therefrom.

In one general aspect, a method for producing refined hydrocarbons from waste plastics includes: a pretreatment process of pretreating waste plastics; a pyrolysis process of producing pyrolysis gas by introducing the waste plastics pretreated in the pretreatment process into a pyrolysis reactor; a lightening process of producing pyrolysis oil by introducing the pyrolysis gas into a hot filter; and a distillation process of distilling the pyrolysis oil to obtain refined hydrocarbons, wherein a liquid condensed in the hot filter is re-introduced into the pyrolysis reactor.

The hot filter may be filled with beads.

The beads may include at least one selected from the group consisting of silica sand ($SiO_2$) and aluminum oxide ($Al_2O_3$).

A temperature gradient may be formed in the hot filter.

The temperature gradient may be formed by providing at least two heaters outside the hot filter for heating the hot filter.

The pyrolysis reactor may include at least two batch reactors.

The pyrolysis process may be performed by a switching operation of the at least two batch reactors.

The pyrolysis oil may be mixed with petroleum hydrocarbons and distilled into mixed oil.

The pyrolysis oil may be included in an amount of 50 wt % or less with respect to the total weight of the mixed oil.

The waste plastics may include at least one selected from the group consisting of polyethylene (PE), polypropylene (PP), polyethylene terephthalate (PET), polyvinyl chloride (PVC), and polystyrene (PS).

In another general aspect, a system for producing refined hydrocarbons from waste plastics includes: a pretreatment device pretreating waste plastics; a pyrolysis reactor for producing pyrolysis gas by introducing the pretreated waste plastics obtained from the pretreatment device; a hot filter for producing pyrolysis oil by introducing the pyrolysis gas obtained from the pyrolysis reactor into the hot filter; a connection pipe connecting the hot filter and the pyrolysis reactor so that a liquid condensed in the hot filter is re-introduced into the pyrolysis reactor; and a distillation device downstream of the hot filter for distilling the pyrolysis oil from the hot filter to obtain refined hydrocarbons.

The hot filter may be filled with beads.

The beads may include at least one selected from the group consisting of silica sand ($SiO_2$) and aluminum oxide ($Al_2O_3$). In an embodiment, the hot filter beads may be silica sand. In another embodiment, the hot filter beads may be aluminum oxide. In yet another embodiment, the hot filter beads may be a mixture of silica sand and aluminum oxide.

The system may further include at least two heaters provided outside the hot filter for providing heat to the hot filter to maintain the contents of the hot filter at a desired temperature.

Other features, aspects, and advantages of the present invention will become apparent from the following detailed description, the drawings, and the claims.

DETAILED DESCRIPTION OF EMBODIMENTS

Figure 1:
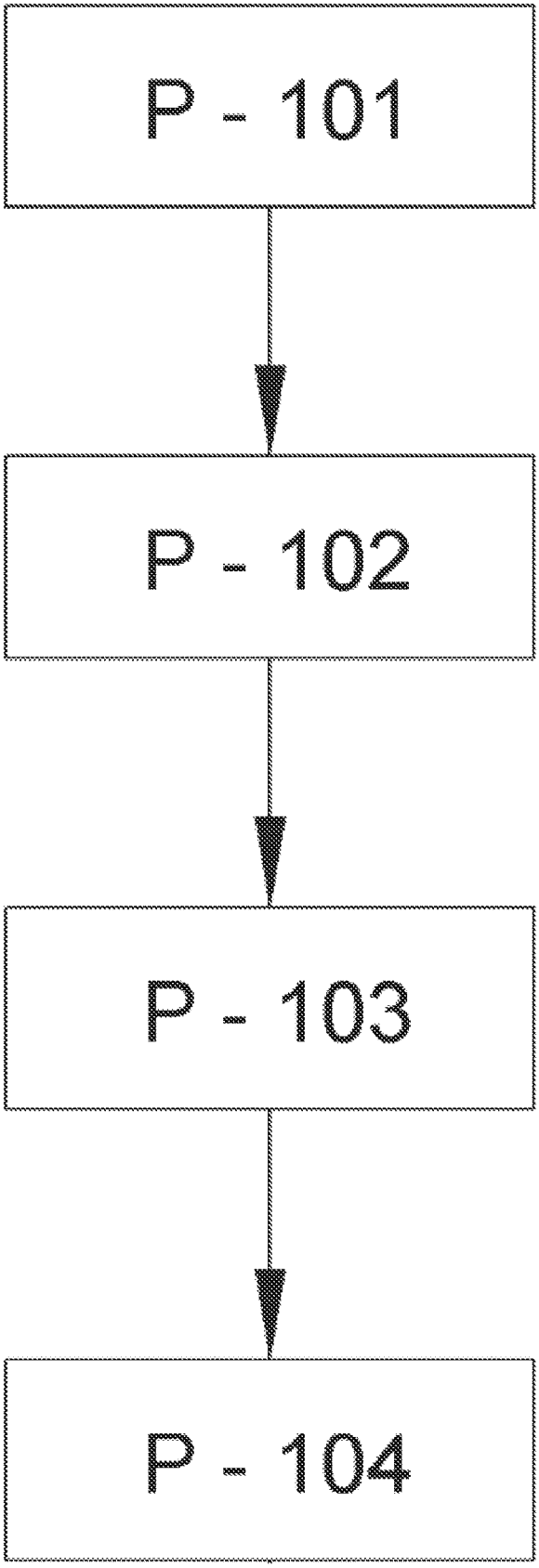
FIG. 1 is a flow diagram of steps of a method according to the invention.

The advantages and features of the embodiments of the present disclosure and methods for accomplishing them will become apparent from the embodiments described below in detail with reference to the accompanying drawings. However, the embodiments are not limited to those disclosed below, but may be implemented in various different forms. These embodiments are provided for making the present disclosure complete and for allowing those skilled in the art to completely recognize the scope of the present disclosure as defined by the appended claims.

Unless defined otherwise, all terms (including technical and scientific terms) used in the present specification have the same meanings as commonly understood by those skilled in the art to which the present disclosure pertains.

Unless the context clearly indicates otherwise, the singular forms of the terms used in the present specification may be interpreted as including the plural forms.

A numerical range used in the present specification includes upper and lower limits and all values within these limits, increments logically derived from a form and span of a defined range, all double limited values, and all possible combinations of the upper and lower limits in the numerical range defined in different forms. Unless otherwise specifically defined in the present specification, values out of the numerical range that may occur due to experimental errors or rounded values also fall within the defined numerical range.

Unless otherwise defined, a unit of "%" used in the present specification refers to "wt %".

In the present specification, the description "A to B" means "A or more and B or less", unless defined otherwise.

In the present specification, the term "pyrolysis oil yield" refers to a weight ratio of oil to the total weight of oil, an aqueous by-product, a pyrolysis residue (char), and by-product gas among the products in the pyrolysis process.

Hereinafter, a method and system for producing refined hydrocarbons from waste plastics of the present disclosure will be described in detail. However, this is only illustrative, and the embodiments of the present disclosure are not limited only to the specific examples which are illustratively described by the present disclosure.

According to an embodiment, a method for producing refined hydrocarbons from waste plastics is provided, the method including: a pretreatment process of pretreating waste plastics (P-101); a pyrolysis process of producing pyrolysis gas by introducing the waste plastics pretreated in the pretreatment process into a pyrolysis reactor (P-102); a lightening process of producing pyrolysis oil by introducing the pyrolysis gas into a hot filter (P-103); and a distillation process of distilling the pyrolysis oil to obtain refined hydrocarbons (P-104), wherein a liquid condensed in the hot filter is re-introduced into the pyrolysis reactor.

Therefore, in the method for producing refined hydrocarbons from waste plastics according to an embodiment of the present disclosure, high-value-added pyrolysis oil having a high proportion of light hydrocarbons may be produced from waste plastics containing a large amount of impurities, and refined hydrocarbons having a high proportion of light hydrocarbons may be obtained therefrom. In addition, a yield of the obtained pyrolysis oil may be significantly improved.

In addition, in the method for producing refined hydrocarbons from waste plastics according to an embodiment of the present disclosure, high-value-added pyrolysis oil with reduced impurities may be produced from waste plastics containing a large amount of impurities, and refined hydrocarbons with reduced impurities may be obtained therefrom.

Figure 2:
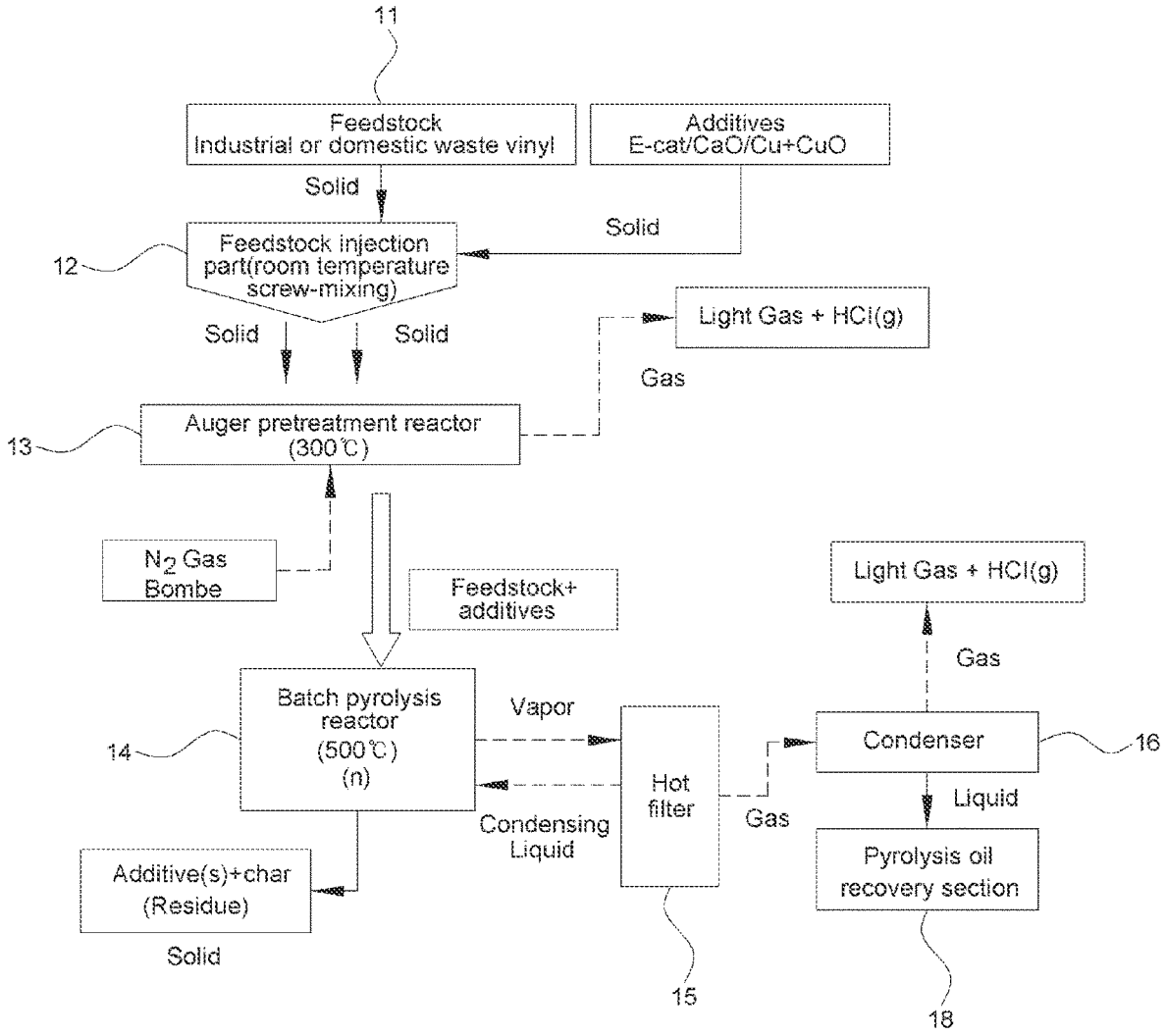
FIG. 2 is a process diagram of a method for producing pyrolysis oil from waste plastics (also referred to as waste plastic pyrolysis oil) according to an embodiment of the present disclosure.
Figure 3:
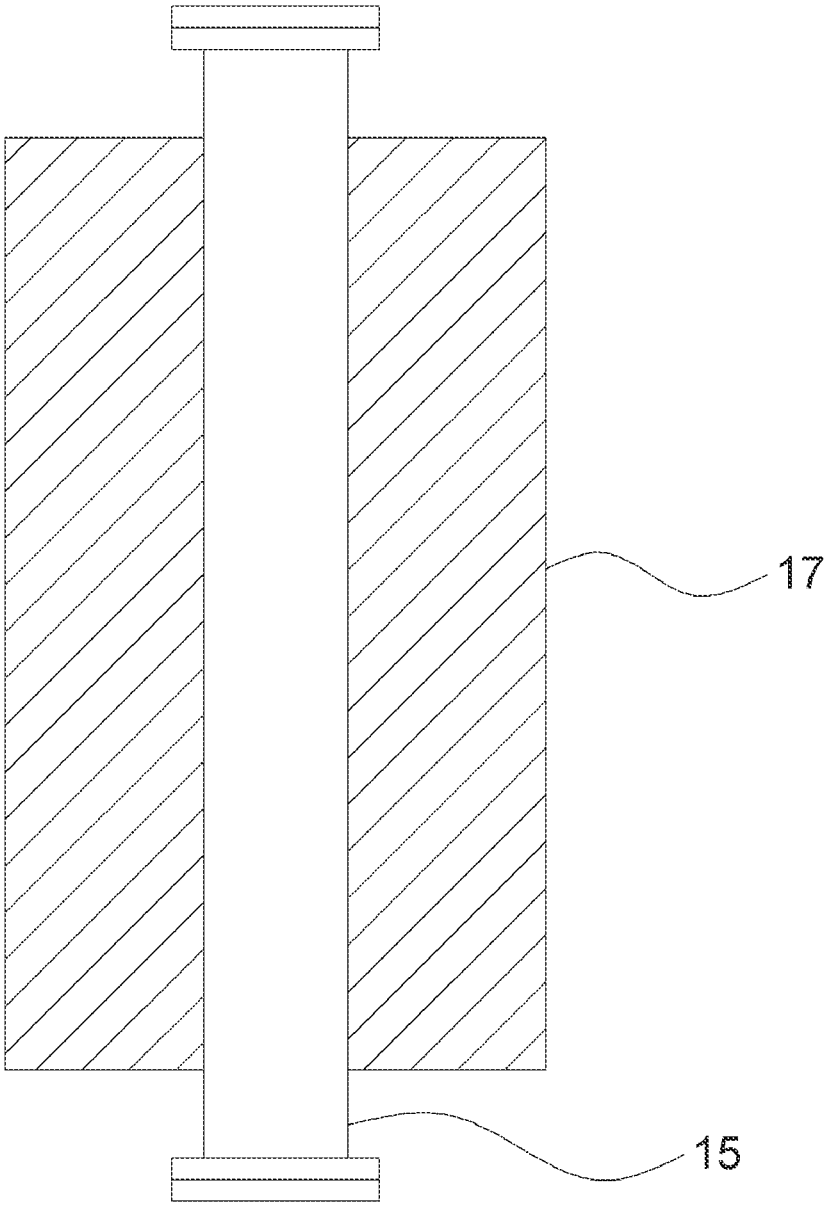
FIG. 3 is a view of a hot filter according to an embodiment of the present disclosure.

Referring now to FIGS. 1 to 3, a method for producing refined hydrocarbons from waste plastics according to an embodiment of the present disclosure is provided. Accordingly, a liquid condensed in a hot filter 15 is re-introduced into the pyrolysis reactor 14, such that cracking of heavy hydrocarbons in pyrolysis oil may be improved. Therefore, pyrolysis oil having a high proportion of light hydrocarbons may be produced, and refined hydrocarbons having a high proportion of light hydrocarbons may be obtained therefrom.

According to another embodiment of the present disclosure, the hot filter 15 may be filled with beads. When the hot filter is filled with beads, an inert effect and a heat transfer effect in the hot filter are maximized, which makes it possible to produce pyrolysis oil having a high proportion of light hydrocarbons. In addition, the pyrolysis oil yield may be improved.

According to an embodiment of the present disclosure, the hot filter 15 may be filled with the beads in an amount of 50 vol % or more, 60 vol % or more, 70 vol % or more, 80 vol % or more, 85 vol % or more, 90 vol % or more, 95 vol % or less, 93 vol % or less, 91 vol % or less, 90 vol % or less, 89 vol % or less, 87 vol % or less, 85 vol % or less, 80 vol % or less, or a value between the above numerical values with respect to an internal volume of the hot filter 15. Specifically, the hot filter may be filled with the beads in an amount of 70 to 95 vol %, 80 to 90 vol %, or 85 to 90 vol %, with respect to the internal volume of the hot filter but is not limited thereto.

According to an embodiment of the present disclosure, a temperature gradient may be formed in the hot filter 15. When a temperature gradient is formed in the hot filter, the pyrolysis gas moving to the top of the hot filter and the liquid condensed to the bottom of the hot filter are efficiently circulated, which makes it possible to produce pyrolysis oil having a high proportion of light hydrocarbons. In n addition, refined hydrocarbons having a high proportion of light hydrocarbons may be obtained therefrom. Further, the pyrolysis oil yield may be improved.

According to an embodiment of the present disclosure, as for the temperature gradient, a temperature at the bottom of the hot filter may be higher than a temperature at the top of the hot filter. According to another embodiment of the present disclosure, as for the temperature gradient, the temperature at the bottom of the hot filter may be higher than a temperature at the middle of the hot filter, and the temperature at the middle of the hot filter may be higher than the temperature at the top of the hot filter. Accordingly, circulation efficiency and heat transfer efficiency in the hot filter may be improved.

According to an embodiment of the present disclosure, the temperature gradient may be formed by providing at least two heaters 17 outside the hot filter 15. According to another embodiment of the present disclosure, the temperature gradient may be formed by providing at least three heaters 17 outside the hot filter. When at least two heaters 17 are provided outside the hot filter, a temperature gradient of the hot filter may be easily formed, and the temperatures at the top, middle, and bottom of the hot filter may be flexibly adjusted depending on operating conditions of the hot filter, such that a flexible process operation may be performed.

According to an embodiment of the present disclosure, the temperature at the bottom of the hot filter 15 may be 400° C. or higher, 420° C. or higher, 440° C. or higher, 460° C. or higher, 480° C. or higher, 500° C. or higher, 550° C. or higher, or 600° C. or higher.

According to an embodiment of the present disclosure, the temperature at the top of the hot filter 15 may be 600° C. or lower, 550° C. or lower, 500° C. or lower, 480° C. or lower, 460° C. or lower, 440° C. or lower, 420° C. or lower, or 400° C. or lower.

According to an embodiment of the present disclosure, the temperature at the middle of the hot filter 15 may be 300° C. or higher and 600° C. or lower, 400° C. or higher and 600° C. or lower, 400° C. or higher and 500° C. or lower, 420° C. or higher and 480° C. or lower, or 440° C. or higher and 460° C. or lower.

According to an embodiment of the present disclosure, in a method, the feedstock 11 of waste plastics is pretreated in the pretreatment process (P-101). In some embodiments, the pretreatment process is performed in an auger pretreatment reactor 13 and may include a two-step pretreatment process. In an operation a), the waste plastics feedstock 11 is reacted with a neutralizing agent; and an operation b) of reacting a product in the operation a) with a copper compound may be performed. Accordingly, in the pretreatment process (P-101), a waste plastic raw material may be treated to reduce a content of Cl to a level that may be introduced into an oil refining process.

According to an another embodiment of the present disclosure, in the operation b), an additive or a neutralizing agent such as a metal oxide or zeolite other than a copper compound may be used. The metal oxide may be in the form of a divalent metal oxide but is not limited thereto.

The waste plastics may include at least one selected from the group consisting of polyethylene (PE), polypropylene (PP), polyethylene terephthalate (PET), polyvinyl chloride (PVC), and polystyrene (PS). The waste plastics may include organic chlorine (organic Cl), inorganic chlorine (inorganic Cl), and aromatic chlorine (aromatic Cl), and a content of chlorine in the waste plastics may be 10 ppm or more, 50 ppm or more, 100 ppm or more, or 100 to 1,000 ppm, but the embodiment is not limited thereto. Pyrolysis oil produced through a cracking or pyrolysis reaction of waste plastics, such as waste plastic pyrolysis oil, contains a large amount of impurities caused by waste plastics. In particular, it is necessary to pretreat pyrolysis oil to remove a chlorine component such as organic/inorganic chlorine. The waste plastics may be divided into domestic waste plastic and industrial waste plastic. The domestic waste plastic is a plastic in which PVC, PS, PET, PBT, and the like in addition to PE and PP are mixed, and may refer to a mixed waste plastic containing 3 wt % or more of PVC together with PE and PP. Since chlorine derived from PVC has a high ratio of organic Cl and inorganic Cl, Cl in domestic waste plastic may be removed with high efficiency even with an inexpensive neutralizing agent (Ca-based, Zn-based, or Al-based) or the like. PE/PP accounts for most industrial waste plastic, but a content of organic Cl originating from an adhesive or a dye component is high, and in particular, a ratio of Cl (aromatic chlorine) contained in an aromatic ring is high, which makes it difficult to remove Cl with the common low-cost neutralizing agent described above.

In the embodiments of the present disclosure, chlorine is removed in an amount of 95 wt % or more, 97 wt % or more, 98 wt % or more, or 99 wt % or more with respect to the total weight of chlorine contained in waste plastics. To this end, it is preferable to remove chlorine contained in the aromatic ring.

The operation a) is an operation of reacting waste plastics with a neutralizing agent, and a large amount of HCl generated during melting and thermal decomposition of PVC and the like may be removed in the form of a neutralizing salt.

The neutralizing agent may be oxide, hydroxide, and carbonate of a metal, or a combination thereof, and the metal may be calcium, aluminum, magnesium, zinc, copper, iron, or a combination thereof. Specifically, the neutralizing agent may be copper oxide, aluminum oxide, calcium oxide, magnesium oxide, zinc oxide, or iron oxide. The neutralizing agent may contain a zeolite component. Specifically, the neutralizing agent may contain a waste fluid catalytic cracking (FCC) catalyst (E-cat) containing a zeolite component, and may further contain a waste FCC catalyst in the metal oxide. Specifically, the neutralizing agent may be calcium oxide, a waste FCC catalyst, copper metal, or copper oxide, or may be calcium oxide.

In an embodiment according to the present disclosure, the neutralizing agent may be added during the pyrolysis process (P-102).

The neutralizing agent may be mixed in an amount of 0.5 to 20 wt %, 1 to 10 wt %, or 1 to 5 wt %, with respect to the total weight of the waste plastics. In addition, the neutralizing agent may be mixed at a molar ratio (NM/Na) of a metal element (M) of the neutralizing agent to a total chlorine element (Cl) in the waste plastics of 1 to 25, specifically, 0.7 to 15, and more specifically, 0.5 to 5.

Moreover, the number of moles of total chlorine elements (Cl) in the waste plastics may refer to a total number of moles of chlorine elements in a waste plastic solid raw material before pretreatment and pyrolysis.

In the chlorine removal in the operation a), a ratio ($A_1$/A) of the content of chlorine in the product in the operation a) to 100 wt % (A) of the content of chlorine in the waste plastics may be 50% or less, 40% or less, or 20 to 30%. Chlorine remaining in waste plastics after the operation a) may be effectively removed in the operation b).

The operation b) is an operation of reacting the product in the operation a) with a copper compound, and a small amount of organic chlorine and aromatic chlorine not removed in the operation a) may be removed with a copper compound (catalyst). When a copper compound is used together with the neutralizing agent in the operation a) or is used as a substitute for the neutralizing agent, the copper compound first reacts with chlorine and inorganic chlorine (HCl) located at the end of the hydrocarbon chain among organic chlorines, which makes it difficult for the copper compound to come into contact with aromatic chlorine or the like, which is difficult to remove with a neutralizing agent. In addition, since the initial pyrolysis performed by raising the temperature inside the reactor for pretreatment or pyrolysis starts at a relatively low temperature (250 to 300° C.), and at this time, HCl begins to be generated, it is preferable to first remove chlorine with a neutralizing agent. Thereafter, when pyrolysis proceeds in earnest, the temperature is relatively high, and a removal reaction of aromatic chlorine is activated. Therefore, it is effective to first remove organic Cl and inorganic Cl with HCl using a neutralizing agent, and then remove aromatic chlorine with a copper compound.

The copper compound may include at least one selected from the group consisting of copper metal (Cu), copper oxide (CuO), copper hydroxide ($Cu(OH)_2$), and copper carbonate ($CuCO_3$), and specifically, copper metal (Cu) and/or copper oxide (CuO).

The copper compound may be mixed in an amount of 0.1 to 20 wt %, 0.5 to 10 wt %, or 1 to 5 wt %, with respect to the total weight of the product in the operation a). In addition, the copper compound may be mixed at a molar ratio (Ncu/Ncl) of a copper element (Cu) of the copper compound to the total chlorine element (Cl) in the waste plastics of 1 to 10, specifically, 0.7 to 5, and more specifically, 0.5 to 3.

Moreover, a total number of moles of chlorine element (Cl) in the waste plastics may refer to a total number of moles of chlorine element in a waste plastic solid raw material before pretreatment and pyrolysis.

In the chlorine removal in the operation b), a ratio ($A_2/A$) of the content of chlorine in the product in the operation b) to 100 wt % (A) of the content of chlorine in the waste plastics may be 10% or less, 5% or less, or 0.5 to 3%.

According to an embodiment of the present disclosure, the operation a) may be performed at a temperature of 200 to 320° C., and the operation b) may be performed at a temperature of 400 to 550° C. When the operations a) and b) are performed in the temperature ranges, respectively, chlorine in the waste plastics may be effectively removed.

According to an embodiment of the present disclosure, in the pyrolysis process (P-102), an operation a) of reacting waste plastics with a neutralizing agent; and an operation b) of reacting a product in the operation a) with a copper compound may be performed.

In the embodiments of the present disclosure, the pretreatment process (P-101) may further include a crushing process of crushing waste plastics by introducing waste plastics into a feedstock injection part 12. The crushing of the waste plastics may be performed by applying a crushing process known in the art. For example, waste plastics may be introduced into a pretreatment reactor 13 and heated to about 300° C. to produce a hydrocarbon flow precursor in the form of pellets, but the embodiments are not limited thereto.

According to an embodiment of the present disclosure, the crushing process may be performed at room temperature.

As an example, in the crushing process, the waste plastics and the neutralizing agent may be mixed, and the mixture may be introduced into a pretreatment reactor 13. When the waste plastics and calcium oxide as the neutralizing agent are mixed and crushed at room temperature, a mechanochemical reaction occurs to generate hydrocarbons and CaOHCl, and therefore, an effect of stably maintaining the form of chlorine in the waste plastic raw material as CaOHCl is obtained.

Subsequently, in the pretreatment process (P-101), the crushed waste plastics may be introduced into the pretreatment reactor 13 and heated, and the solid waste plastic raw material may be physically and chemically treated to remove chlorine, thereby producing a hydrocarbon flow precursor (pyrolysis raw material). The hydrocarbon flow precursor may mean a waste plastic melt, and the waste plastic melt may mean that all or a part of crushed or uncrushed solid waste plastics is converted into liquid waste plastic.

As an example, in the pretreatment process (P-101), each of the crushed or uncrushed waste plastics and the neutralizing agent may be introduced into the pretreatment reactor 13 and heated. In addition, in the pretreatment process (P-101), the crushed or uncrushed waste plastics and the neutralizing agent may be introduced into the pretreatment reactor 13, and then a first pretreatment (heating) may be performed, and subsequently, a copper compound may be introduced into the pretreatment reactor 13, and then a second pretreatment (heating) may be performed.

The heating may be performed at a temperature of 200 to 320° C. and normal pressure. Specifically, the heating may be performed at a temperature of 250 to 320° C. or 280 to 300° C. In general, the pretreatment temperature of the waste plastics is at least 250° C., but hydrocarbons after the dechlorination may be easily pretreated even at a lower temperature of 200° C. to generate hydrogen or methane gas.

The pretreatment reactor 13 may be an extruder, an autoclave reactor, a batch reactor, or the like, and may be, for example, an auger reactor, but the embodiments are not limited thereto.

The pyrolysis process (P-102) may be performed by introducing pyrolysis raw materials classified into three material phases: a gas phase, a liquid phase (oil+wax+water), and a solid phase into the pyrolysis reactor 14, and specifically, may be an operation of introducing the non-pretreated or pretreated waste plastics into the pyrolysis reactor 14 and performing heating.

As an example, the pyrolysis process (P-102) may be performed by mixing pretreated waste plastics and a copper compound, introducing the mixture into a pyrolysis reactor 14, and heating the mixture. In addition, in the pyrolysis process (P-102), a first pyrolysis is performed by mixing waste plastics and a neutralizing agent, introducing the mixture into a pyrolysis reactor 14, and heating the mixture, and then a second pyrolysis is performed by introducing a copper compound into the pyrolysis reactor 14 and performing heating, and at least two times of pyrolysis may be performed continuously or discontinuously.

The heating may be performed at a temperature of 320 to 900° C., specifically, 350 to 700° C., and more specifically, 400 to 550° C., in a non-oxidizing atmosphere. In addition, the heating may be performed at normal pressure. The non-oxidizing atmosphere is an atmosphere in which waste plastics do not oxidize (combust), and may be, for example, an atmosphere in which an oxygen concentration is adjusted to 1 vol % or less, or an atmosphere of an inert gas such as nitrogen, water vapor, carbon dioxide, or argon.

When the heating temperature is 400° C. or higher, fusion of chlorine-containing plastics may be prevented, and conversely, when the heating temperature is 550° C. or lower, chlorine in waste plastics may remain in a pyrolysis residue (char) in the form of $CaCl_2$), $CuCl_2$, or the like.

The pyrolysis may be performed in an autoclave reactor, a batch reactor, a fluidized-bed reactor, a packed-bed reactor, or the like, and specifically, any reactor capable of controlling stirring and a rise in temperature may be applied. According to an embodiment of the present disclosure, the pyrolysis may be performed in a batch reactor.

According to an embodiment of the present disclosure, the pyrolysis reactor 14 may include at least two batch reactors.

According to an embodiment of the present disclosure, the pyrolysis process (P-102) may be performed by a switching operation of the at least two batch reactors to run the at least two batch reactors alternately. Accordingly, the pyrolysis process may secure process continuity even at a high temperature.

In the method for producing refined hydrocarbons from waste plastics according to an embodiment of the present disclosure, the pyrolysis process (P-102) or the lightening process (P-103) may further include at least one process selected from the group consisting of a pyrolysis gas recovery process of recovering a pyrolysis gas phase and a pyrolysis liquid phase as gas and a separation process of separating a pyrolysis solid phase (solid content) into fine particles and coarse particles.

In the pyrolysis gas recovery process, pyrolysis gas containing low-boiling-point hydrocarbon compounds such as methane, ethane, and propane in the gas phase generated in the pyrolysis process or the lightening process is recovered. The pyrolysis gas may generally contain combustible materials such as hydrogen, carbon monoxide, and low-molecular-weight hydrocarbon compounds. Examples of the hydrocarbon compounds include methane, ethane, ethylene, propane, propene, butane, and butene. Such pyrolysis gas contains a combustible material and may be used as fuel.

In the separation process, the solid content in the solid phase generated in the pyrolysis process or the lightening process, for example, carbides, the neutralizing agent, and/or the copper compound may be separated into fine particles and coarse particles. Specifically, classification is performed using a sieve having a size smaller than an average particle diameter of the chlorine-containing plastics and larger than an average particle diameter of the neutralizing agent or the copper compound, such that the solid content generated by the pyrolysis reaction may be separated into fine particles and coarse particles. In the separation process, it is preferable to separate the solid content into fine particles containing a relatively large amount of the chlorine-containing neutralizing agent and the copper compound, and coarse particles containing a relatively large amount of carbides. The fine particles and carbides may be retreated as necessary, reused in the pyrolysis process, used as fuel, or disposed of as waste, but the embodiments of the present disclosure are not limited thereto.

According to an embodiment of the present disclosure, the hot filter 15 may be filled with at least one selected from the group consisting of beads and a neutralizing agent.

According to another embodiment of the present disclosure, the hot filter 15 may be filled with beads. When the hot filter is filled with beads, an inert effect and a heat exchange effect in the hot filter are maximized, which makes it possible to produce pyrolysis oil having a high proportion of light hydrocarbons.

According to an embodiment of the present disclosure, the beads may include at least one selected from the group consisting of silica sand ($SiO_2$) and aluminum oxide ($Al_2O_3$). Specifically, when the beads include silica sand ($SiO_2$), the inert effect and the heat exchange effect in the hot filter may be maximized, and a stable process operation may be performed without wear even during a long-term high-temperature operation.

According to an embodiment of the present disclosure, the beads may be glass beads, but are not limited thereto.

According to an embodiment of the present disclosure, a diameter of the bead may be 0.1 mm or more, 1 mm or more, 1.5 or more, 2 mm or more, 2.5 mm or more, 3 mm or more, 10 mm or less, 8 mm or less, 6 mm or less, 4 mm or less, 3.5 mm or less, 3 mm or less, 2.5 mm or less, 2 mm or less, or a value between the above numerical values, and specifically, may be 1 mm to 5 mm, 2 mm to 4 mm, or 2.5 mm to 3.5 mm, but is not limited thereto. In the lightening process (P-103) of the present disclosure, the hot filter is filled with beads having the particle size described above, such that lightening of oil may be achieved by adjusting a gas hourly space velocity (GHSV) of the pyrolysis gas, and process operation efficiency may be improved due to suppression of a differential pressure in the hot filter.

According to an embodiment of the present disclosure, in the lightening process (P-103), pyrolysis oil may be produced by introducing the pyrolysis gas into the hot filter filled with a neutralizing agent.

The lightening process (P-103) may be performed in an oxygen-free atmosphere at a temperature of 400 to 550° C. and a pressure of normal pressure to 0.5 bar, and the oxygen-free atmosphere may be an inert gas atmosphere or a closed system atmosphere without oxygen. In the temperature range of the lightening process, the lightening of the pyrolysis gas is performed well, such that clogging and a differential pressure caused by wax may be suppressed.

Moreover, in the lightening process (P-103), a gas hourly space velocity (GHSV) may be 0.3 to 1.2/hr or 0.5 to 0.8/hr. Accordingly, it is possible to lighten a waste plastic pyrolyzed product and reduce impurities (Cl and the like) without performing an additional post-treatment process, and it is possible to produce pyrolysis oil having a high proportion of light hydrocarbons and refined hydrocarbons having a high proportion of light hydrocarbons as intended in the present disclosure by adjusting the GHSV of the pyrolysis gas.

The neutralizing agent filled in the hot filter may have a particle size of 400 to 900 μm, or may have a particle size of 500 to 800 μm. Under the operating conditions in the lightening process (P-103) of the present disclosure, the hot filter is filled with the neutralizing agent having the particle size described above, such that lightening of oil may be achieved by adjusting the GHSV of the pyrolysis gas, and process operation efficiency may be improved due to suppression of a differential pressure in the hot filter.

Further, the particle size may refer to D50, and D50 refers to a particle diameter when a cumulative volume from a small particle size accounts for 50% in measuring a particle size distribution by a laser scattering method. In this case, as for D50, the particle size distribution may be measured by collecting the sample from the prepared carbonaceous material according to KS A ISO 13320-1 standard using Mastersizer 3000 manufactured by Malvern Panalytical Ltd. Specifically, ethanol may be used as a solvent, and if necessary, the ethanol is dispersed using an ultrasonic disperser, and then, a volume density may be measured.

According to an embodiment of the present disclosure, the hot filter 15 may be filled with the beads and the neutralizing agent.

The hot filter 15 generally serves to separate pyrolysis gas and a residue (char) among pyrolyzed products in the art. However, in the present disclosure, a hot filter filled with at least one selected from the group consisting of beads and a neutralizing agent is applied for removal of impurities (Cl) as well as lightening, and therefore, as described above, operating conditions such as a temperature of the hot filter and a particle size of the neutralizing agent are adjusted to specific ranges.

The lightening process (P-103) may satisfy the following Relational Expressions 1 and 2.

$$50<(A_2-A_1)/A_1(\%)<100 \quad \text{[Relational Expression 1]}$$

$$-80<(B_2-B_1/B_1)\ (\%)<-50 \quad \text{[Relational Expression 2]}$$

In Relational Expression 1, $A_1$ represents a total amount (wt %) of naphtha (boiling point of 150° C. or lower) and kerosene (boiling point of 150 to 265° C.) of the pyrolysis gas, and $A_2$ represents a total amount (wt %) of naphtha (bp of 150° C. or lower) and kerosene (bp of 150 to 265° C.) of the pyrolysis oil, and in Relational Expression 2, $B_1$ represents a content (ppm) of chlorine in the pyrolysis gas, and $B_2$ represents a content (ppm) of chlorine in the pyrolysis oil.

Specifically, Relational Expressions 1 and 2 may be $60<(A_2-A_1)/A_1$ (%)$<90$, $65<(A_2-A_1)/A_1$ (%)$<85$, or $70<(A_2-A_1)/A_1$ (%)$<80$, and $-75<(B_2-B_1/B_1)$ (%)$<-55$, $-70<(B_2-B_1/B_1)$ (%)$<-55$, or $-65<(B_2-B_1/B_1)$ (%)$<-55$, respectively.

Relational Expressions 1 and 2 numerically represent a degree of light and heavy of the waste plastic pyrolyzed product when the hot filter filled with at least one selected from the group consisting of beads and a neutralizing agent of the present disclosure is used. The embodiments of the present disclosure have a technical feature of producing pyrolysis oil having a high proportion of light hydrocarbons by controlling the oil composition and the content of chlorine in the pyrolysis gas introduced into the hot filter and the organic/inorganic materials containing chlorine.

The pyrolysis oil produced in the lightening process (P-103) may include, with respect to the total weight, 30 to 50 wt % of naphtha (bp of 150° C. or lower), 30 to 50 wt % of kerosene (bp of 150 to 265° C.), 10 to 30 wt % of light gas oil (LGO) (bp of 265 to 380° C.), and 0 to 10 wt % of UCO-2/AR (bp of 380° C. or higher), and specifically, may include 35 to 50 wt % of naphtha (bp of 150° C. or lower), 35 to 50 wt % of kerosene (bp of 150 to 265° C.), to 30 wt % of light gas oil (LGO) (bp of 265 to 380° C.), and 0 to 8 wt % of UCO-2/AR (bp of 380° C. or higher) or 35 to 45 wt % of naphtha (bp of 150° C. or lower), 35 to 45 wt % of kerosene (bp of 150 to 265° C.), 10 to 20 wt % of light gas oil (LGO) (bp of 265 to 380° C.), and 0 to 6 wt % of UCO-2/AR (bp of 380° C. or higher). In addition, in the pyrolysis gas, a weight ratio of light oils (the sum of naphtha and kerosene) to heavy oils (the sum of LGO and UCO-2/AR) may be 2.5 to 5, 2.5 to 4, or 3 to 3.8.

In the pyrolysis oil produced in the lightening process (P-103), a total content of chlorine may be less than 100 ppm, 80 ppm or less, 60 ppm or less, 5 to 50 ppm, or 10 to 50 ppm, with respect to the total weight, and a content of organic chlorine may be less than 90 ppm, 70 ppm or less, 50 ppm or less, to 50 ppm, or 5 to 40 ppm, with respect to the total weight.

According to an embodiment of the present disclosure, the pyrolysis process and the lightening process may satisfy the following Relational Expression 3.

$$0.7<T_2/T_1<1.3 \quad \text{[Relational Expression 3]}$$

In Expression 3, $T_1$ and $T_2$ are temperatures at which the pyrolysis process and the lightening process are performed.

In a case where the pyrolysis process and the lightening process are performed so that the $T_2/T_1$ value satisfies 0.7 or less, the temperature of the pyrolysis process may be relatively high, or the temperature of the lightening process may be relatively low. In this case, a ratio of pyrolysis oil that is condensed in the hot filter and then circulated to the pyrolysis reactor increases, and thus, a final boiling point of the pyrolysis oil may be excessively low. On the other hand, the pyrolysis process and the lightening process are performed so that the $T_2/T_1$ value satisfies 1.3 or more, a loss ratio of the pyrolysis oil in a gas phase may excessively increase, and thus, the pyrolysis oil yield may be reduced.

Specifically, $T_2/T_1$ may be, for example, 0.7 to 1.2, 0.8 to 1.2, 0.8 to 1.1, 0.9 to 1.1, or 1. Therefore, the effects described above may be further improved.

According to an embodiment of the present disclosure, the method for producing refined hydrocarbons from waste plastics of the present disclosure may include a distillation process (P-104).

In an embodiment of the present disclosure, the pyrolysis oil may be mixed with petroleum hydrocarbons and distilled into mixed oil.

The petroleum hydrocarbon refers to a mixture of naturally occurring hydrocarbons or a compound separated from the mixture. Specifically, the petroleum hydrocarbon may be at least one selected from the group consisting of crude oil and hydrocarbons derived from crude oil, but the embodiments of the present disclosure are not limited thereto.

According to an embodiment of the present disclosure, the distillation may be performed in at least one process selected from the group consisting of a crude distillation unit (CDU) and a vacuum distillation unit (VDU).

According to an embodiment of the present disclosure, in the distillation process (P-104), refined hydrocarbons may be obtained in the form of naphtha at a boiling point of 150° C. or lower, kerosene at a boiling point of 150 to 265° C., light gas oil (LGO) at a boiling point of 265 to 340° C., and vacuum gas oil (VGO) at a boiling point of 340° C. or higher.

In an embodiment according to the present disclosure, the pyrolysis oil may be included in an amount of 60 wt % or less, 50 wt % or less, or 40 wt % or less, with respect to the total weight of the mixed oil.

In addition, the present disclosure provides a system for producing refined hydrocarbons from waste plastics. A description of contents overlapped with those described in the method for producing refined hydrocarbons from waste plastics will be omitted.

The present disclosure provides a system for producing refined hydrocarbons from waste plastics, the system including: a pretreatment device pretreating waste plastics; a pyrolysis reactor for producing pyrolysis gas by introducing the waste plastics pretreated in the pretreatment device; a hot filter for producing pyrolysis oil by introducing the pyrolysis gas; a connection pipe connecting the hot filter and the pyrolysis reactor so that a liquid condensed in the hot filter is re-introduced into the pyrolysis reactor; and a distillation device distilling the pyrolysis oil to obtain refined hydrocarbons.

The system of the present disclosure may produce high-value-added pyrolysis oil having a high proportion of light hydrocarbons from waste plastics containing a large amount of impurities, and may produce refined hydrocarbons having a high proportion of light hydrocarbons therefrom. In addition, the system of the present disclosure may improve a yield of the pyrolysis oil obtained from waste plastics.

According to an embodiment of the present disclosure, the hot filter may be filled with beads. When the hot filter is filled with beads, an inert effect and a heat transfer effect in the hot filter are maximized, which makes it possible to produce pyrolysis oil having a high proportion of light hydrocarbons. In addition, the pyrolysis oil yield may be improved.

According to an embodiment of the present disclosure, the beads may include at least one selected from the group consisting of silica sand ($SiO_2$) and aluminum oxide ($Al_2O_3$).

According to an embodiment of the present disclosure, the system may further include at least two heaters 17 provided outside the hot filter 15. In addition, the system may include at least three heaters 17 outside the hot filter 15. When at least two heaters 17 are provided outside the hot filter 15, a temperature gradient of the hot filter may be easily formed, and the temperatures at the top, middle, and bottom of the hot filter may be flexibly adjusted depending on operating conditions of the hot filter, such that a flexible process operation may be performed.

According to an embodiment of the present disclosure, a method for producing refined hydrocarbons may comprises: pretreating a waste plastics feedstock by reacting the waste plastics feedstock with a neutralizing agent, and at least one of a copper compound, and a divalent metal oxide to produce a pretreated waste plastics mixture, producing pyrolysis gas by subjecting the pretreated waste plastics mixture to a pyrolysis reaction; separating low-boiling-point hydrocarbon compounds from the pyrolysis gas, producing a pyrolysis oil; and distilling the pyrolysis oil to obtain refined hydrocarbons.

Referring to FIG. 2, a feedstock 11 was injected into a feedstock injection part 12 and screw-mixing was performed. The crushed waste plastics and additive (s) were introduced into an auger pretreatment reactor 13, and then a pretreatment was performed. The pretreated waste plastics were introduced into pyrolysis reactor 14, and pyrolysis was performed, thereby producing pyrolysis gas. The produced pyrolysis gas was introduced into a hot filter 15 and then lightened. And then the lightened pyrolysis gas was introduced into condenser 16 and pyrolysis oil was obtained in a pyrolysis oil recovery section 18. A liquid condensed in the hot filter 15 was re-introduced into the pyrolysis reactor 14.

Hereinafter, embodiments of the present disclosure will be further described with reference to specific experimental examples. The examples and comparative examples included in the experimental examples are merely illustrative of the present disclosure and do not limit the scope of the accompanying claims, and it is apparent to those skilled in the art that various modifications and alterations may be made without departing from the spirit and scope of the present disclosure, and it is apparent that these modifications and alterations are within the accompanying claims. Therefore, the scope of the present disclosure should not be limited to the above-described embodiments but should include the equivalents thereof.

In the above-described embodiments, all operations may be selectively performed or part of the operations may be omitted. In each embodiment, the operations are not necessarily performed in accordance with the described order and may be rearranged. The embodiments disclosed in this specification and drawings are only examples to facilitate an understanding of the present disclosure, and the present disclosure is not limited thereto. That is, it should be apparent to those skilled in the art that various modifications can be made on the basis of the technological scope of the present disclosure.

The embodiments of the present disclosure have been described in the drawings and specification. Although specific terminologies are used here, those are only to describe the embodiments of the present disclosure. Therefore, the present disclosure is not restricted to the above-described embodiments and many variations are possible within the scope of the present disclosure. It should be apparent to those skilled in the art that various modifications can be made on the basis of the technological scope of the present disclosure in addition to the embodiments disclosed herein. Furthermore, the embodiments may be combined to form additional embodiments.

In the present specification, the term "pyrolysis oil yield" refers to a weight ratio of oil to the total weight of oil, an aqueous by-product, a pyrolysis residue (char), and by-product gas among the products in the pyrolysis process.

Example 1

78.8 wt % of PE, 11.6 wt % of PP, and 3.1 wt % of PVC were contained in industrial waste plastics used as a feedstock.

1,020 g of the industrial waste plastic feedstock was injected into a feedstock injection port and screw-mixing was performed. The crushed waste plastics and CaO were introduced into an auger reactor at 200 g/hr and 10 g/hr, respectively, and then a pretreatment was performed at a screw speed of 10 rpm, a nitrogen flow rate of 3 cc/min, 300° C., and a residence time of 1 hr.

The pretreated waste plastics were introduced into a rotary kiln batch pyrolysis reactor, and pyrolysis was performed at a rotary kiln rotation speed of 4 rpm and 430° C., thereby producing pyrolysis gas.

The produced pyrolysis gas was introduced into a 1.3 L hot filter not filled with glass beads and then lightened, and then pyrolysis oil was obtained in a recovery section. A liquid condensed in the hot filter was re-introduced into the pyrolysis reactor.

The pyrolysis oil was introduced into a crude distillation unit (CDU) and then distilled, and refined hydrocarbons were obtained in the form of naphtha at a boiling point of 150° C. or lower, kerosene at a boiling point of 150 to 265° C., light gas oil (LGO) at a boiling point of 265 to 340° C., and vacuum gas oil (VGO) at a boiling point of 340° C. or higher. The pyrolysis oil yield is shown in Table 1, and the weight ratio of the refined hydrocarbons is shown in Table 2.

Example 2

A process was performed in the same manner as that of Example 1, except that a 1.3 L hot filer was filled with glass beads having a diameter of 3 mm at 88 vol % with respect to the internal volume of the hot filter, and the top temperature, the middle temperature, and the bottom temperature of the hot filter were maintained at 430° C.

Example 3

A process was performed in the same manner as that of Example 1, except that a 1.3 L hot filter was filled with glass beads having a diameter of 3 mm at 88 vol % with respect to the internal volume of the hot filter, the top temperature of the hot filter was maintained at 430° C., and the middle temperature and the bottom temperature of the hot filter were maintained at 500° C.

Example 4

A process was performed in the same manner as that of Example 1, except that a 1.3 L hot filter was filled with glass beads having a diameter of 3 mm at 88 vol % with respect to the internal volume of the hot filter, the top temperature of the hot filter was maintained at 430° C., the middle temperature of the hot filter was maintained at 450° C., and the bottom temperature of the hot filter was maintained at 500° C.

Example 5

A process was performed in the same manner as that of Example 1, except that mixed oil obtained by mixing the pyrolysis oil and crude oil at a weight ratio of 5:95 was introduced into a crude distillation unit (CDU).

Comparative Example 1

A process was performed in the same manner as that of Example 1, except that the liquid condensed in the hot filter was not re-introduced into the pyrolysis reactor.

Measurement Methods

The composition of the waste plastic feedstock was analyzed using Flake analyzer available from RTT System GmbH, Germany, among NIR analyzers.

GC-Simdis analysis (HT 750) was performed to confirm the composition of pyrolyzed products related to pyrolysis oil yield measurement.

In order to analyze impurities such as Cl, S, N, and O, ICP, TNS, EA-O, and XRF analysis were performed. The total content of Cl was measured according to ASTM D5808, the content of N was measured according to ASTM D4629, and the content of S was measured according to ASTM D5453.

TABLE 1

| | Comparative Example 1 | Example 1 | Example 2 | Example 3 | Example 4 |
|---|---|---|---|---|---|
| Pyrolysis oil yield (wt %) | 52.1 | 55.1 | 57.0 | 60.8 | 62.4 |

TABLE 2

| Weight ratio of refined hydrocarbons (wt %) | Comparative Example 1 | Example 1 | Example 2 | Example 3 | Example 4 |
|---|---|---|---|---|---|
| Naphtha | 23.4 | 28.3 | 35.2 | 40.1 | 40.3 |
| Kerosene | 34.2 | 37.4 | 35.4 | 42.1 | 44.6 |
| LGO | 23.1 | 20.1 | 15.1 | 9.6 | 10 |
| VGO | 19.3 | 14.2 | 14.3 | 8.2 | 5.1 |
| Total of naphtha and kerosene | 57.6 | 65.7 | 70.6 | 82.2 | 84.9 |

In Comparative Example 1 in which the hot filter was not filled with beads and the liquid condensed in the hot filter was not re-introduced into the pyrolysis reactor, it was confirmed that the pyrolysis oil yield and the proportion of light oil including naphtha and kerosene were the lowest.

In the case of Example 1 in which the liquid condensed in the hot filter was re-introduced into the pyrolysis reactor, it was confirmed that an excellent pyrolysis oil yield and an excellent proportion of light hydrocarbons including naphtha and kerosene were achieved compared to Comparative Example 1.

In Example 2 in which the liquid condensed in the hot filter was re-introduced into the pyrolysis reactor and the hot filter was filled with beads, it was confirmed that the pyrolysis oil yield and the proportion of light hydrocarbons including naphtha and kerosene were superior to those in Example 1.

In Examples 3 and 4 in which the liquid condensed in the hot filter was re-introduced into the pyrolysis reactor, the hot filter was filled with beads, and a temperature gradient was formed in the hot filter, the pyrolysis oil yield and the proportion of light hydrocarbons including naphtha and kerosene were superior to those in Examples 1 and 2.

In particular, in Example 4 in which the top temperature, the middle temperature, and the bottom of the hot filter were maintained at 430° C., 450° C., and 500° C., respectively, it was confirmed that the pyrolysis oil yield and the proportion of light hydrocarbons including naphtha and kerosene were the best.

As set forth above, according to an embodiment of the present disclosure, high-value-added pyrolysis oil having a high proportion of light hydrocarbons may be produced from waste plastics containing a large amount of impurities, and refined hydrocarbons having a high proportion of light hydrocarbons may be obtained therefrom.

According to an embodiment of the present disclosure, a yield of the pyrolysis oil obtained from waste plastics may be improved.

According to an embodiment of the present disclosure, high-value-added pyrolysis oil with reduced impurities may be produced from waste plastics containing a large amount of impurities, and refined hydrocarbons with reduced impurities may be obtained therefrom.

According to another embodiment of the present disclosure, when refined hydrocarbons are produced from waste plastics, a process may be simplified.

According to an embodiment of the present disclosure, high-value-added pyrolysis oil having a high proportion of light hydrocarbons that may be used as a feedstock for blending with existing petroleum products or an oil refining process due to its excellent quality may be produced, and refined hydrocarbons having a high proportion of light hydrocarbons may be obtained therefrom.

The method and system for producing refined hydrocarbons from waste plastics according to an embodiment of the present disclosure may be used to produce eco-friendly petrochemical products using waste plastics.

The content described above is merely an example of applying the principles of the present disclosure, and other configurations may be further included without departing from the scope of the present disclosure.

LIST OF NUMERALS

P-101 pretreatment process
P-102 pyrolysis process
P-103 lightening process
P-104 distillation process
11 feedstock
12 feedstock injection part
13 auger pretreatment reactor
14 pyrolysis reactor
hot filter
16 condenser
17 heater
18 pyrolysis oil recovery section

What is claimed is:

1. A method for producing refined hydrocarbons from waste plastics, the method comprising:

a pretreatment process of pretreating waste plastics;

a pyrolysis process of producing pyrolysis gas by introducing the waste plastics pretreated in the pretreatment process into a pyrolysis reactor;

a lightening process of producing pyrolysis oil by introducing the pyrolysis gas into a hot filter; and a distillation process of distilling the pyrolysis oil to obtain refined hydrocarbons, wherein a liquid condensed in the hot filter is re-introduced into the pyrolysis reactor.

2. The method of claim 1, wherein the hot filter is filled with beads.

3. The method of claim 2, wherein the beads include at least one selected from the group consisting of silica sand ($SiO_2$) and aluminum oxide ($Al_2O_3$).

4. The method of claim 1, wherein a temperature gradient is formed in the hot filter.

5. The method of claim 4, wherein the temperature gradient is formed by providing at least two heaters outside the hot filter.

6. The method of claim 1, wherein the pyrolysis reactor includes at least two batch reactors.

7. The method of claim 6, wherein the pyrolysis process is performed by a switching operation of the at least two batch reactors.

8. The method of claim 1, wherein the pyrolysis oil is mixed with petroleum hydrocarbons and distilled into mixed oil.

9. The method of claim 8, wherein the pyrolysis oil is included in an amount of 50 wt % or less with respect to the total weight of the mixed oil.

10. The method of claim 1, wherein the waste plastics include at least one selected from the group consisting of polyethylene (PE), polypropylene (PP), polyethylene terephthalate (PET), polyvinyl chloride (PVC), and polystyrene (PS).

11. A method for producing refined hydrocarbons, the method comprising:

pretreating a waste plastics feedstock by reacting the waste plastics feedstock with a neutralizing agent, and at least one of a copper compound, and a divalent metal oxide to produce a pretreated waste plastics mixture, producing pyrolysis gas by subjecting the pretreated waste plastics mixture to a pyrolysis reaction;

separating low-boiling-point hydrocarbon compounds from the pyrolysis gas, producing a pyrolysis oil; and distilling the pyrolysis oil to obtain refined hydrocarbons.

* * * * *